US005769707A

United States Patent [19]

Jang et al.

[11] Patent Number: 5,769,707

[45] Date of Patent: Jun. 23, 1998

[54] METHOD AND APPARATUS FOR BROADENING AN AIR DISCHARGE PATTERN FROM A ROOM AIR CONDITIONER

[75] Inventors: Kyung-Seog Jang; Gab-Youl Lee, both of Suwon, Rep. of Korea

[73] Assignee: Samsung Electronics Co., Ltd., Suwon, Rep. of Korea

[21] Appl. No.: 764,108

[22] Filed: Dec. 6, 1996

[30] Foreign Application Priority Data

| | | | |
|---|---|---|---|
| Dec. 12, 1995 | [KR] | Rep. of Korea | 1995-48876 |
| Apr. 13, 1996 | [KR] | Rep. of Korea | 1996-11136 |
| Apr. 13, 1996 | [KR] | Rep. of Korea | 1996-11137 |

[51] Int. Cl.[6] ..... F24F 13/06

[52] U.S. Cl. ..... 454/233; 454/285

[58] Field of Search ..... 454/229, 230, 454/231, 233, 234, 256, 285, 286, 306, 316

[56] References Cited

U.S. PATENT DOCUMENTS 3,165,052 1/1965 Brinen ..... 454/285

FOREIGN PATENT DOCUMENTS 2-287043 11/1990 Japan ..... 454/256

2-287045 11/1990 Japan ..... 454/256

*Primary Examiner*—Harold Joyce

*Attorney, Agent, or Firm*—Burns, Doane, Swecker & Mathis, L.L.P.

[57] ABSTRACT

A room air conditioner includes a housing forming an air inlet and an air outlet, a blower for circulating air through the housing, and a heat exchanger for changing the air temperature as the air flows through the housing. An upper portion of the housing which possesses the air outlet is oscillatable about a vertical axis relative to a lower portion of the housing which possesses the air inlet. A drive mechanism oscillates the upper portion in response to the manual inputting of an oscillation signal to a controller. When the air conditioner is shut off, the upper portion is rotated by 180 degrees to expose a more attractive side of the upper portion to viewers in the room.

11 Claims, 8 Drawing Sheets

METHOD AND APPARATUS FOR BROADENING AN AIR DISCHARGE PATTERN FROM A ROOM AIR CONDITIONER

FIELD OF THE INVENTION

The present invention relates to a discharging apparatus of an air conditioner and control method thereof for broadening the range of discharging air, and enhancing the exterior appearance of an air conditioner.

DESCRIPTION OF THE PRIOR ART

FIG. 1 shows a conventional air conditioner.

An indoor unit body 1 (hereinafter referred to as indoor unit ) is arranged at the bottom of a front side thereof with a suction grill member 5 consisting of multiple suction inlets 3 for sucking the room air and a filter member 7, for preventions dust, foreign objects and the like from being infused into the indoor unit through a suction inlet 3.

Meanwhile, a discharge outlet 9 is provided with a wind direction up and down control member 11 and a wind direction left and right control member 13.

The indoor unit body 1 is coupled to a front cover member 15 forming an enclosure thereof. Furthermore, as illustrated in FIG. 2, the filter member 7 is arranged in front of a heat exchanger 17 so as to heat-exchange the room air sucked through the filter member 7 to form cool air or warm air by way of latent heat of a refrigerant.

The heat exchanger 17 is arranged at the upper part with an indoor fan 19 for sucking the room air through the suction inlet 3 and simultaneously for discharging the air heat-exchanged by the heat exchanger 17 through the discharge outlet 9.

Furthermore, the indoor fan 19 disposed in a duct member 21 configured to cover the indoor fan 19 and to suck the room air through the suction inlet 3 and to guide the flow of air discharged through the discharge outlet 9.

In the thus-constructed air conditioner, the user manipulates a manipulating means 102 or remote controller to select a desired room temperature.

The indoor fan 19 is then driven and simultaneously room air is sucked into the indoor unit body 1 through the suction inlet 3.

Foreign objects like dust being infused through the suction inlet 3 are removed by the filter member 7, and the room air is heat-exchanged by way of latent heat of a refrigerant. The air heat-exchange in the heat-exchanger 17 is guided upwardly by the duct member 21 and discharged into a room through the discharge outlet 9.

At this time, the wind direction up and down control member 11 and the wind direction left and right control member 13 control the direction of the air being discharged into the room through the discharge outlet 9.

In the thus-constructed air conditioner, the direction of the air being discharged from the indoor unit 1 is controlled only by the wind direction up and down control member 11 and the wind direction left and right control member 13 that control is limited and may not provide a pleasant air direction.

Furthermore, there is another problem in that an exterior of the indoor unit 1 is not beautiful due to the opening of discharge outlet 9 arranged in front of the indoor unit 1 when the air conditioner is not operated.

SUMMARY OF THE INVENTION

The present invention is therefore disclosed to solve the afore-mentioned problem, and it is an object of the present invention to provide a discharging apparatus of an air conditioner and a control method thereof for broadening the air discharging range, and thereby maintaining a pleasant room temperature condition.

It is another object of the present invention to provide a discharging apparatus of an air conditioner and a method thereof in which an upper cabinet an be rotated at an angle of 180 degrees and thereby present a more pleasant appearance during non-operating periods.

In accordance with one aspect of the present invention there is provided a discharging apparatus of an air conditioner, comprising:

- a lower cabinet being formed with a suction inlet for sucking room air;
- an upper cabinet being formed with a discharge outlet and being rotatably provided at the upper side of the lower cabinet;
- operation manipulating means for inputting a selection signal to rotate the upper cabinet;
- control means for controlling the rotation operation of the upper cabinet according to the selection signal inputted by the operation manipulating means;
- driving means for controlling direction of air being discharged through the discharge outlet and for rotating the upper cabinet; and
- position detecting means for detecting the position of the upper cabinet being rotated according to a control signal of the driving means.

In accordance with the present invention a discharging control method of an air condidioner provides an air conditioner comprising the step of:

- inputting a selection signal for rotating an upper cabinet which is formed with a discharge outlet for discharging heat-exchanged air;
- rotating the upper cabinet by the operation of driving means for controlling direction of air discharged and for beautifying the exterior of an indoor unit;
- detecting the rotated position of the upper cabinet by the operation of the driving means; and
- controlling the power supply source to the driving means according to the rotated position of the upper cabinet.

BRIEF DESCRIPTION OF THE DRAWING

For a fuller understanding of the nature and objects of the invention, reference should be made to the following detailed description taken in conjunction with the accompanying drawings in which.

DETAILED DESCRIPTION OF A PREFERRED EMBODIMENT OF THE INVENTION

Figure 1:
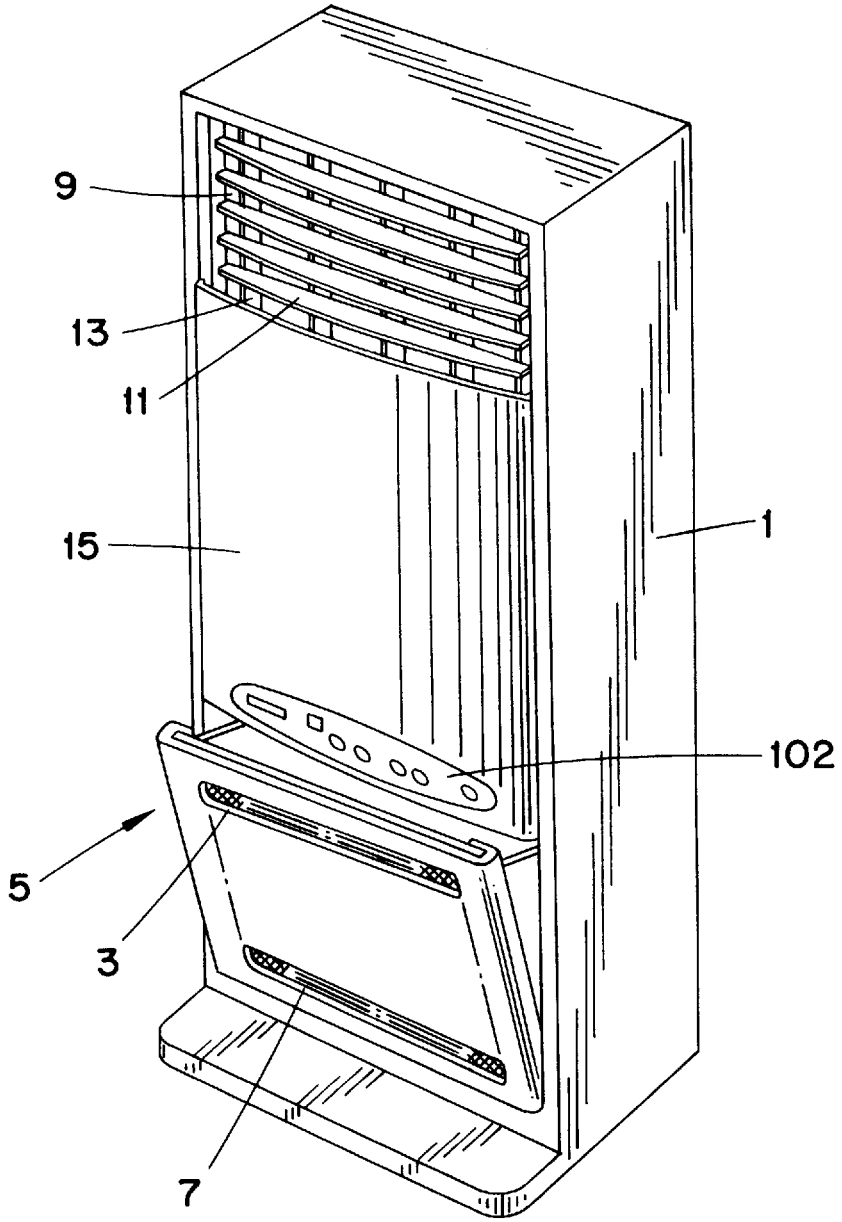
FIG. 1 (PRIOR ART)
FIG. 1 is a perspective view for illustrating a conventional air conditioner.
Figure 2:
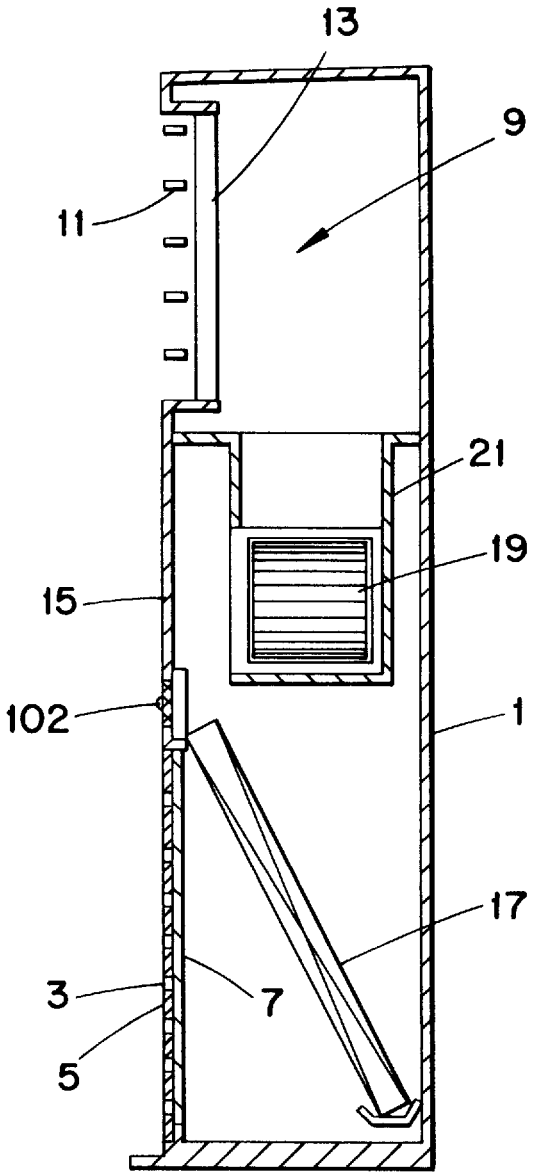
FIG. 2 (PRIOR ART)
FIG. 2 is a sectional view for illustrating the conventional air conditioner.

The embodiment of the present invention will now be described in detail with reference to the accompanying drawings.

Throughout the drawings, like reference numerals and symbols are used for designation of like or equivalent parts or portions for simplicity of illustration and detailed description thereof is omitted.

Figure 3:
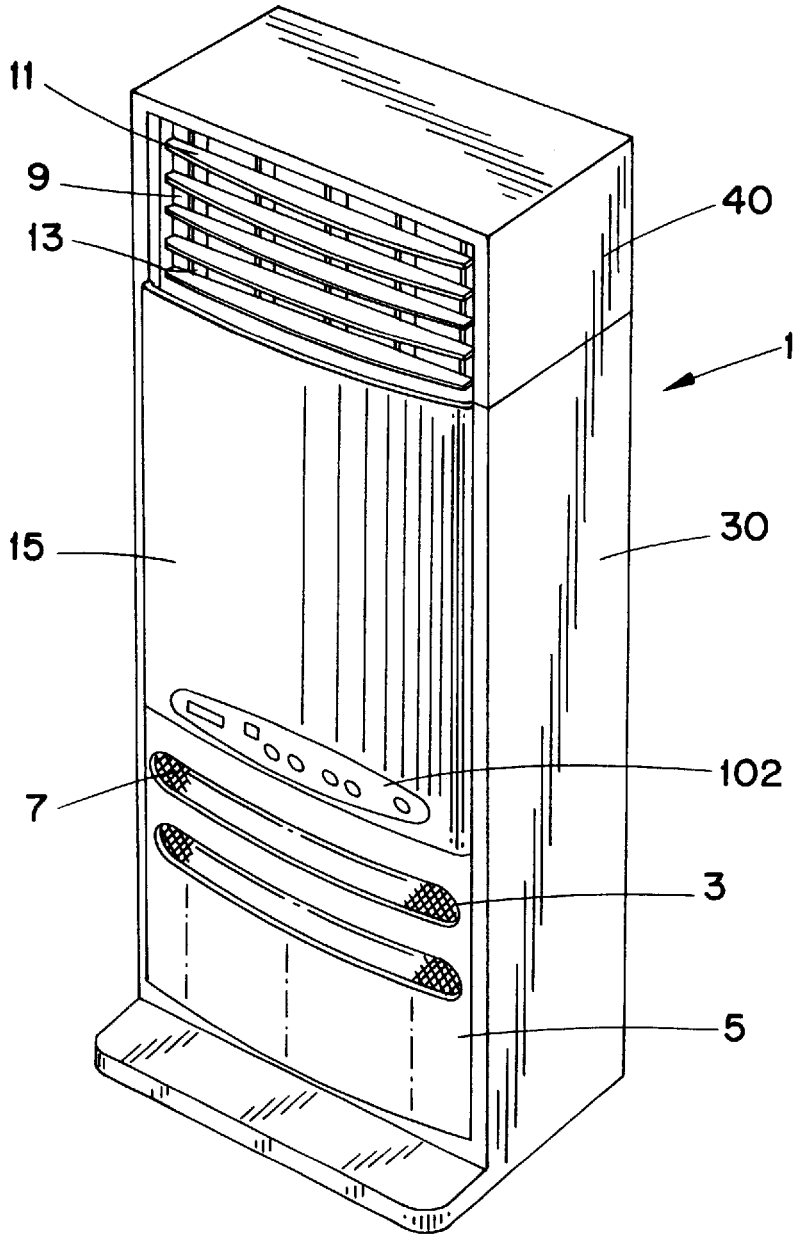
FIG. 3 is a perspective view for illustrating an air conditioner according to the present invention.

As illustrated in FIG. 3, an indoor unit body 1 (hereinafter referred to as indoor unit) is divided into two parts namely, an upper cabinet 40 and a lower cabinet 30. The upper cabinet 40 is rotatably arranged on the upper side of the lower cabinet 40.

Figure 4:
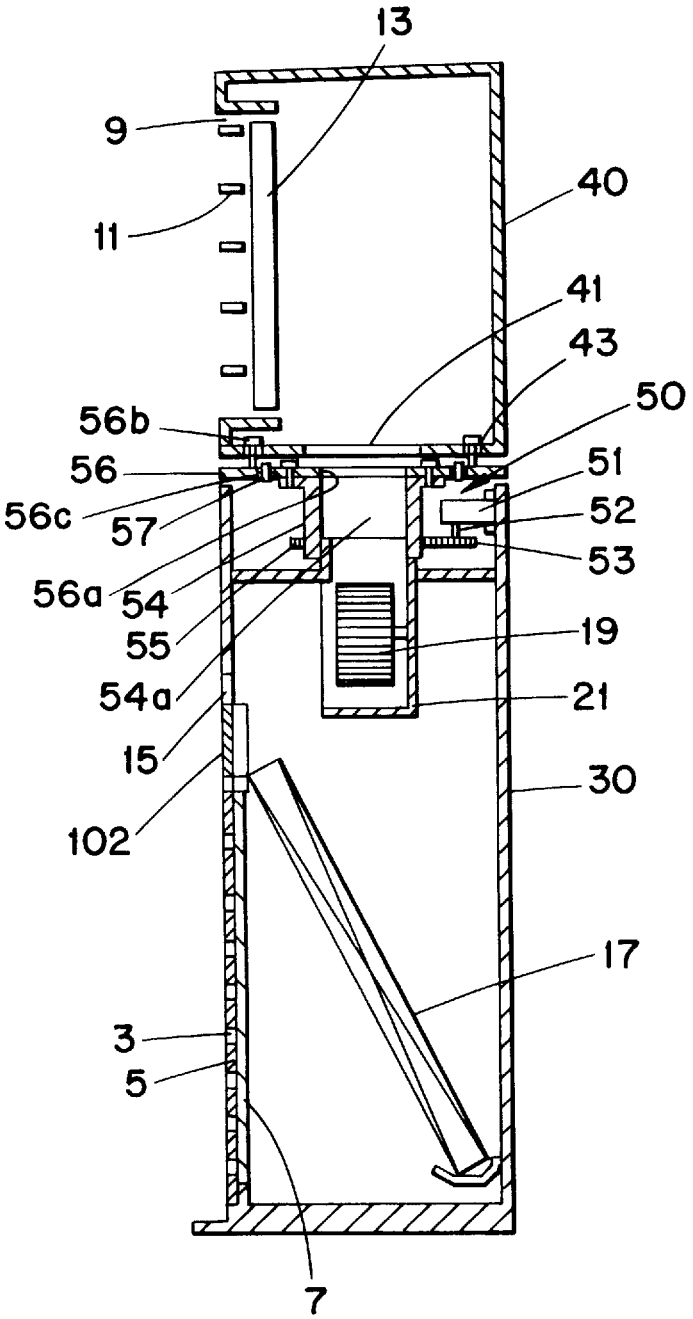
FIG. 4 is a longitudinal sectional view for illustrating the air conditioner according to the present invention.
Figure 5:
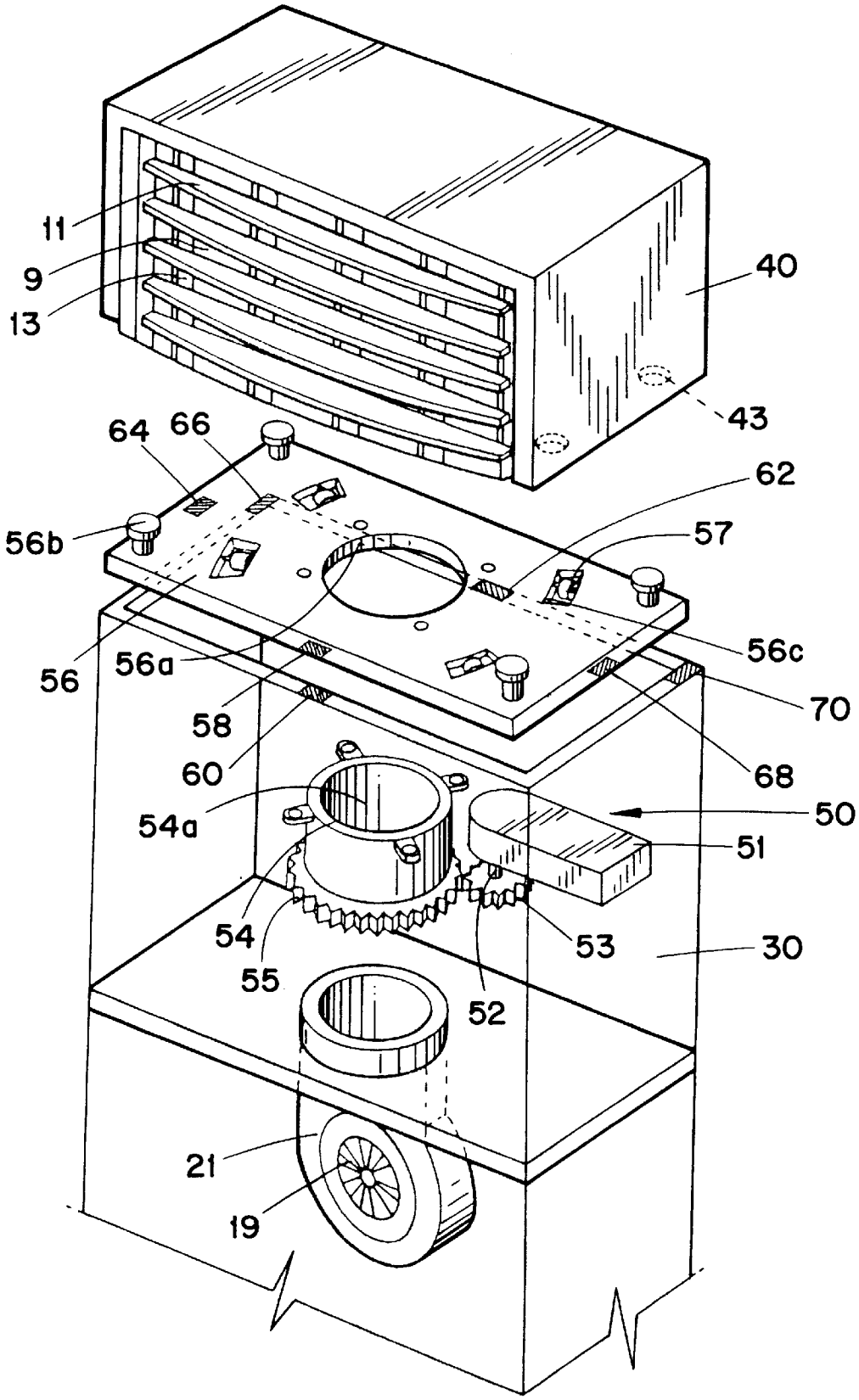
FIG. 5 is an exploded perspective view for illustrating the air conditioner according to the present invention.

As illustrated in FIG. 4 and FIG. 5, the lower cabinet 30 is arranged at the upper side thereof with driving means 50 for rotating the upper cabinet 40 at a predetermined angle up to 180 degrees with respect to the lower cabinet 30.

The upper cabinet 40 is arranged at the lower side thereof with a hole 41 for sucking the heat-exchanged air into the inside thereof.

Meanwhile, the driving means 50 includes a motor 51 coupled to one side of the lower cabinet 30 so as to generate a mechanical power, a first gear 53 installed on a motor axle member 52 of the motor 51 for rotating right or left by the power of the motor 51, and a second gear 55 geared into the first gear 53 and simultaneously coupled to the outer surface of a connection member 54 for being rotated right or left by the rotation of the first gear 53 thereby causing the connection member 54 to be rotated, and a rotation plate 56 coupled to the upper side of the connection member 54 for carrying the upper cabinet 40.

The connection member 54 is formed at the inner side thereof with a hole 54*a* for passing air heat-exchanged by a heat-exchanger 17 disposed in a duct member 21.

The inner diameter of the hole 54*a* for passing the heat-exchanged air is more than the outer diameter of the duct member 21 to enable the member 54 to be rotated easily without interference by the duct member 21.

The rotating plate 56 is provided at the middle portion thereof with a passage hole 56*a* for introducing the air passing through the hole 54*a* into the upper cabinet 40, and also is provided with a plurality of boss members 56*b* inserted into respective fixing holes of the upper cabinet 40.

The passage hole 56*a* is provided with grooves 56*c* which are coupled roller members 57 for enabling the upper cabinet 40 to rotate easily. Meanwhile, the lower cabinet 30 is arranged on the upper front side thereof with a first position detecting sensor 60 for detecting whether or not the upper cabinet 40 and the lower cabinet 30 coincide exactly by contacting with a contact member 58 disposed on the rotation plate 56.

The lower cabinet 30 is provided on the upper rear side thereof with a second position detecting sensor 62 for detecting whether or not the upper cabinet 40 is rotated at an angle of 180 degrees relative to the lower cabinet 30.

Furthermore, the lower cabinet 30 is provided on the upper left side thereof with a third position detecting sensor 66 for detecting the position of the upper cabinet 40 when the latter has been rotated to the left relative to the lower cabinet 30, and also is provided on the upper right side thereof with a fourth position detecting sensor 70 for detecting the position of the upper cabinet 40 when the latter has been rotated to the right relative to the lower cabinet 30.

Next, the control block diagram for rotating the upper cabinet formed with the discharge outlet will be described in detail with reference to FIG. 6.

Figure 6:
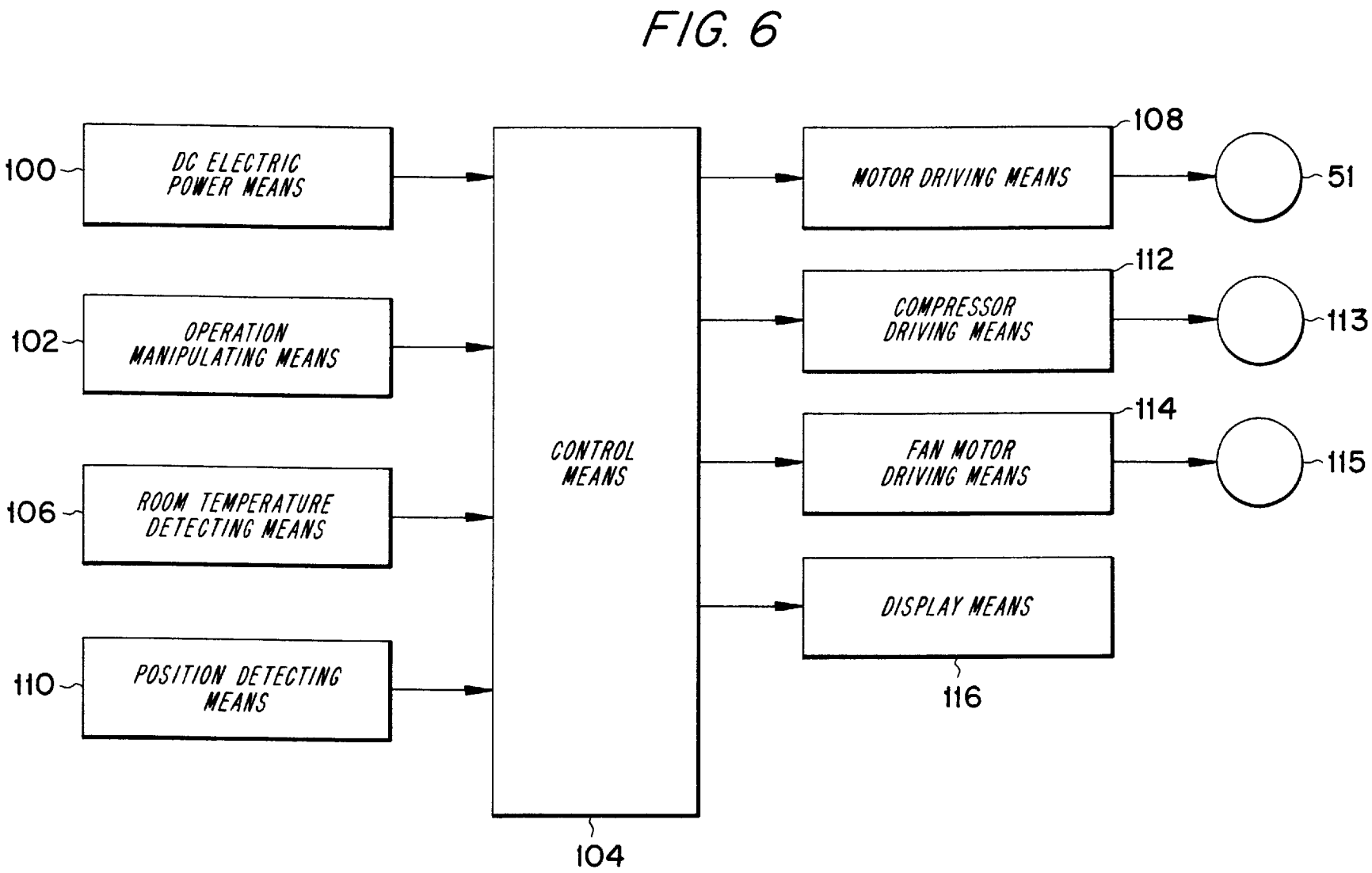
FIG. 6 is a control block diagram of a discharge apparatus of an air conditioner according to the present invention.

As illustrated in FIG. 6, a direct current DC electric power means 100 serves to receive a power source voltage of commercial alternating current electric power supplied from an AC power source input terminal to thereby transform same to a predetermined DC voltage necessary for operation of the air conditioner.

Operation manipulating means 102 has a plurality of functional keys (artificial intelligence, cooling, warming air cleaning, booked operation, stop and the like) so as to input operation conditions of the air conditioner desired by a user, and has a signal input key for inputting an operation start signal and an operation stop signal into the air conditioner and also has a rotation key for rotating the upper cabinet to enable its discharge outlet 9 to cover a wide scope.

Control means 104 is a microcomputer which serves to receive the DC voltage output from the DC electric power means 100 to initialize the air conditioner, and at the same time, to control overall operations of the air conditioner according to the operation selecting signal and operation and stop operation signals input from the operating manpulating means 102.

The control means 104 controls the supply of electric power to the motor 51 thereby causing the upper cabinet 40 to be controlled according to the operation signal and the rotation signal.

Room temperature detecting means 106 detects an actual temperature Tr of the room air sucked through the suction inlet 3.

Motor driving means 108 serves to receive a control signal output from the control means 104 when the operation key and the rotation key on the operating manipulating means 102 are selected to controllably drive the motor 51 so that the upper cabinet 40 formed with the discharge outlet 9 is rotated.

Position detecting means 110 serves to sense the angle to which the upper cabinet 40 is rotated with respect to the lower cabinet 30 and to output the sensed value to the control means 104.

Furthermore, the position detecting means 110 includes the position detecting sensors 60, 62, 66 and 70.

Compressor driving means 112 serves to receive a control signal from the control means 104 according to a difference between the reference temperature Ts established by the user and the room actual temperature Tr detected by the room temperature detecting means 106, to thereby controllably drive a compressor 113.

Fan motor driving means 114 is adapted to receive a control signal from the control means 104 to energize an indoor fan motor 115 which drives the indoor fan 19.

Display means 116 serves to display an operation condition established by the operation manipulating means 102, and to display reference temperature Ts, and operation conditions according to a control signal generated from the control means 104.

Figure 7A:
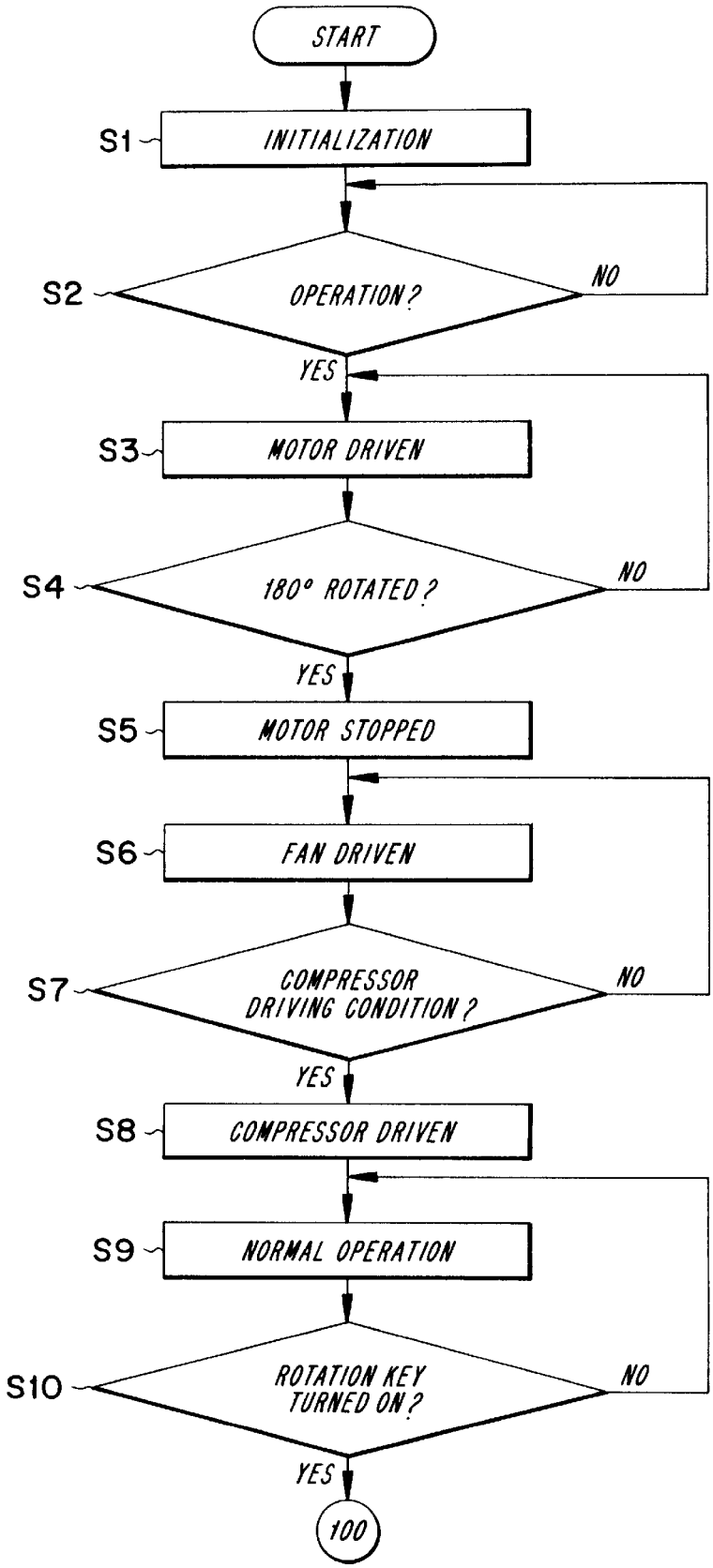
FIGS. 7A and 7B are flow charts respectively illustrating the method for controlling the discharging operation of the air conditioner according to the present invention.
Figure 7B:
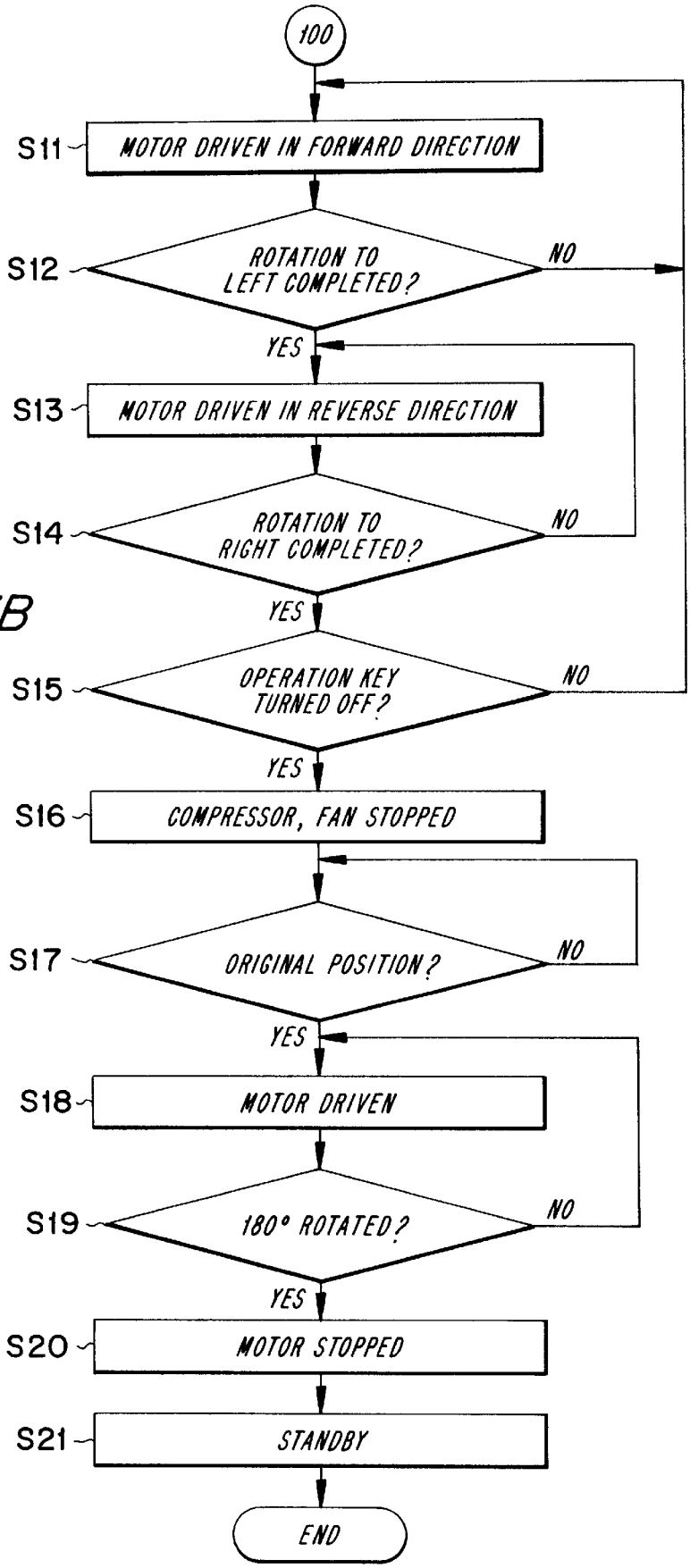

Now, the operation effect of the discharging apparatus of the air conditioner thus constructed and a control method thereof will be described with reference to FIGS. 7A and 7B.

As an initial condition for describing the operation of the present invention, it is assumed that the discharge outlet 9 formed at the upper cabinet 40 is situated at the back side of the indoor unit 1.

First of all, the DC electric power means 100 serves to convert commercial AC power to a predetermined DC voltage necessary for driving the air conditioner and to output same to respective driving circuits and the control means 104.

At step S1, the control means 104 serves to receive the DC voltage output from the DC electric power means 100 to initialize the air conditioner.

At this time, when the user manipulates the operation manipulating means 102 to select desired manipulating command conditions (i.e., cold room, warm room, dehumidification, cleanness and the like) and the predetermined temperature Ts and the predetermined wind quantity and the predetermined wind direction, and inputs an operation key signal, the operation starting signal and the manipulating command from the operation manipulating means 102 are inputed into the control means 104.

During this time period, at step S2, the control means 104 serves to discriminate whether operation key signal is inputted. If the operation key signal is not inputted (in case of NO), flow returns to the step S2 to thereby execute repeatedly the operation subsequent to the step S2 until the operation key signal is inputted.

As a result of the discrimination of the step S2, if the operation key signal is inputted (in case of YES), flow advances to the step S3 to execute the operation of the air conditioner, where the control means 104 serves to output a control signal to the motor driving means 108 for rotating the upper cabinet 40 at an angle of 180 degrees so as to turn the discharge outlet 9 situated at first in the back side of the indoor unit 1 toward the front of the indoor unit 1.

Therefore, the motor driving means 108 serves to drive the motor 51 according to the control signal generated from the control means 104 and to thereby rotate counterclockwise the first gear 53 coupled with the motor shaft member 52, and to thereby rotate clockwise the connection member 54 according to reverse rotation of the second gear 55.

Thus, the rotating plate 56 coupled with the connection member 54 is rotated and the upper cabinet 40 coupled with the rotating plate 56 is rotated at an angle of 180 degrees and thereby the discharge outlet 9 is situated at the front side of the indoor unit 1.

If the upper cabinet 40 is rotated at an angle of 180 degrees at step S4 the contact member 58 provided on the lower part of the rotation plate 56 is contacted by the first position sensor 60 provided on the upper side of the lower cabinet 30 to thereby detect the rotated position of the upper cabinet 40.

The control means 104 serves to discriminate whether the upper cabinet 40 is rotated at an angle of 180 degrees perfectly according to the signal detected by the first position sensor 60.

As a result of the discrimination at the step S4, if the upper cabinet 40 is not rotated at an angle of 180 degrees perfectly (in case of NO), flow returns to the step S3 and executes repeatedly the operation of the motor 51 until the upper cabinet 40 is rotated at an angle of 180 degrees perfectly.

If the upper cabinet 40 is rotated at an angle of 180 degrees (in case of YES), flow advances to step S5, where the motor driving means 108 serves to stop the motor 61 and thereby the rotating operation of the upper cabinet 40 is finished.

At step S6, the fan motor driving means 114 serves to control the rotation speed of the indoor fan motor 115 which drives the indoor fan 19.

If the indoor fan 19 is driven, room air is sucked into the indoor unit 1 through the suction inlet 3. At this time, the room air temperature detecting means 106 serves to detect the temperature of room air Tr sucked through the suction inlet 3 and output the detected signal to the control means 104.

Successively, at step S7, a comparison is made between the room actual temperature Tr and the reference temperature Ts established by the user, thereby discriminating whether the compressor 113 needs to be actuated.

That is, assuming at step S7 that either: (A) for cooling operation it is determined that actual room temperature Tr is greater than the reference temperature Ts, or (B) for a heating operation it is determined that the actual room temperature Tr is less than the reference temperature Ts; in either case the answer is yes.

As a result of the discrimination at step S7 if the compressor 113 need not be driven (in case of NO), flow returns to the step S6, and executes the operation to detect the room temperature Tr continuously and performs repeatedly the operations subsequent to the step S6.

If the result is a need for driving the compressor 113 (in case of YES), flow advances to the step S8, where the control means 30 serves to determine an operational frequency of the compressor 113 according to the difference between the room temperature Tr and the reference temperature Ts to thereby cause a control signal for driving the compressor 113 to be generated to the compressor driving means 112.

Subsequently, the compressor driving means 112 is adapted to drive the compressor 113 according to the operational frequency determined by the control means 104.

When the compressor 113 is driven, at the step S9, the indoor fan 19 is driven and to thereby room air is sucked into the lower cabinet 30.

Foreign objects floating in the room air sucked through the suction inlet 3 are removed by the filter member 7, and the filtered room air is heat-exchanged by a latent heat of refrigerant in the heat-exchanger 17.

The heat-exchanged air is guided upwardly through the duct member 21, is infused into the inner side of the upper cabinet 40 through the penetration hole 56*a* of the rotation plate 56 and the penetration hole 40*a* of the upper cabinet 40 as describe above. The direction of air sucked into the inner side of the upper cabinet 40 is controlled by the wind direction up and down control member 11 and the wind direction left and right control member 13.

At step S10, the control means 104 discriminates whether the rotation signal producing key provided on the operation manipulating means 102 is "on". If the rotation key signal generated from the rotation signal producing key doesn't input to the control means 104 (in case of NO), flow returns to the step S9 and the air conditioner performs a normal operation.

As a result of discrimination of the step S10, if the rotation key signal generated from the rotation signal producing key inputs to the control means 104 (in case of YES), flow advances to the step S11, the control means 104 serves to output a control signal to the upper cabinet 40 for turning it left.

Accordingly, the motor driving means 108 serves to drive the motor 51, and to thereby turn right the first gear 53 coupled with the motor shaft member 52, and turn left the second gear 55 geared with the first gear 53. Therefore, the connection member 54 coupled to the inner side of the second gear 55 turns clockwise.

Then, the rotation plate 56 coupled to the connection member 54 rotates, and the upper cabinet 40 turn to the left.

If the upper cabinet 40 is turned left at the step S12, the contact member 64 arranged below the left side of the rotation plate 56 is contacted by the third position detecting sensor 66 arranged on the left side of the lower cabinet 30, to thereby detect a rotated position to the left.

The control means 104 serves to receive the detected signal generated from the third position detecting sensor 66, and to thereby discriminate whether or not the upper cabinet 40 is rotated to the left fully.

At a result of discrimination of the step S12, if the upper cabinet 40 is not rotated to the left fully (in case of NO), flow returns to the step S11, and the control means 104 serves to output a control signal to the motor driving means so that the motor 51 is controllably driven until the upper cabinet 40 is rotated to the left fully.

If the upper cabinet 40 is rotated to the left fully (in case of YES), flow advances to the step S13, and the control means 104 serves to output a control signal to the motor driving means 108 so as to rotate to the right, the upper cabinet 40 which has been rotated to the left fully.

Therefore, the motor driving means 108 serves to drive the motor 51 according to the control signal generated from the control means 104 and to thereby rotate the first gear 53 in the opposite direction (to the right).

Furthermore, when the second gear 55 geared into the one side of the first gear 53 is rotated to the left, the connection member 54 coupled with the second gear 55 is rotated to the right.

The rotation plate 56 coupled with the connection member 54 is rotated counter-clockwise and the upper cabinet 40 is rotated counter-clockwise therewith.

If the upper cabinet 40 is rotated to the right at the step S14, the contact member 68 arranged below the right side of the rotation plate 56 serves to detect the rotated position to the right by contacting with the fourth position detecting sensor 70, and the control means discriminates whether or not the upper cabinet 40 is rotated to the right fully.

At a result of discrimination of the step 14 the upper cabinet 40 is not rotated to the right fully (in case of NO), flow returns to the step S 13, and the control means 104 serves to output a control signal to the motor driving means so that the motor 51 is controllably driven until the upper cabinet 40 is rotated to the right fully.

If the upper cabinet 40 is rotated to the right fully (in case of YES), flow advances to the step S15, and where the control means 104 discriminates whether or not the operation key is "off". If the operation key is not "off" (in case of NO), flow returns to the step S11, and where the motor 51 is rotated to the right or left repeatedly, and thereby rotating the upper cabinet to the right or left repeatedly, and, at the same time, performing repeatedly the operations subsequent to the step S11.

Therefore, the room air sucked into the lower cabinet 30 through the suction inlet 3 according to the operation of the indoor fan 19 passes through the heat-exchanger 17, where, the room air is heat-exchanged by the latent heat of a refrigerant passing through the heat-exchanger and the heat-exchanged air is guided upwardly by the duct member 21, and through the hole 54*a* of the connection member 54, and then through the hole 56*a* and the hole 41, and infused into the upper cabinet 40.

As illustrated above, the discharge direction of air from the upper cabinet 40 is controlled by the wind direction up and down control member 11 and the wind direction left and right control member 13, and, at the same time, the heatex-changed air is discharged in every direction through the discharge outlet 9 according to rotation of the upper cabinet 40 to the right or to the left.

At a result of discrimination of the step S15, if the operation key is "off" (in case of YES) flow advances to the step S16, and the control means 104 serves to output control signals to the compressor driving means 112 and the fan motor driving means 114 for stopping operation of the compressor 113 and the indoor fan 19 respectively.

Therefore, the compressor driving means 112 serves to stop the compressor 113, and the fan motor driving means 114 also serves to stop the indoor fan 19 according to the control signals generated from the control means 104.

Successively, at step S17, the control means 104 discriminates whether or not the upper cabinet 40 is fixed to the lower cabinet 30 at a primary position in which the contact member 58 is contacted with the first position detecting sensor 60.

As a result of discrimination of the step S17, if the upper cabinet 40 is not returned to the primary position (in case of NO), motor driving means 108 serves to drive the motor 51 continuously until the upper cabinet 40 is fixed at the primary position and perform operations subsequent to the step S17.

If the upper cabinet 40 is returned to the primary position (in case of YES) at step S17, flow advances to step S18. At step S18, the control means 104 serves to output a control signal for rotating the upper cabinet 40 at an angle of 180 degrees to the motor driving means 108 so that the discharge outlet 9 is situated at the rear side of indoor unit 1.

Therefore, the motor driving means 108 serves to drive the motor 51 according to the control signal generated from the control means 104, and thereby the first gear 53 coupled with the motor shaft member 52 is rotated clock-wise, and successively, the second gear 55 is rotated counter clock-wise, the connection member 54 coupled with the second gear 55 is rotated counter clock-wise according to the rotation of the second gear 55.

Furthermore, the rotation plate 56 is rotated according to the rotation of the connection member 54, and the upper cabinet 40 is rotated at an angle of 180 degrees, and thereby the discharge outlet 9 is situated at the rear side of the indoor unit 1.

If the upper cabinet 40 is rotated at an angle of 180 degrees, at step S19, the contact member 58 comes in contact with the second position detecting sensor 62. Therefore, the second position detecting sensor 62 detects a rotated position of the upper cabinet 40, and therefore, the control means 104 discriminates whether or not the upper cabinet 40 is rotated fully at an angle of 180 degrees according to the signal detected by the second position detecting sensor 62.

As a result of discrimination of the step S19, if the upper cabinet 40 is not rotated at an angle of 180 degrees (in case of NO), flow returns to the step S18, and the motor driving means 108 serves to drive the motor 51 until the upper cabinet 40 is rotated fully at an angle of 180 degrees.

If the upper cabinet 40 is rotated at an angle of 180 degrees (in case of YES), flow advances to the step S20, and the motor driving means 108 serves to stop the motor 51 according to a control signal generated from the control means 104.

Successively, at step 21, the control means 104 serves to finish operation of the air conditioner until the operation key is "on", and also serves to order to stand by.

As is apparent from the foregoing, when the air conditioner is driven, the upper cabinet formed with the discharge outlet is rotated to the right and left, and thereby the wind direction control range is broadened, and indoor room becomes pleasant. When the air conditioner is not driven, the upper cabinet provided with the discharge outlet is rotated by an angle of 180 degrees and thereby the visible exterior of the indoor unit is more attractive and also the mold inside the indoor unit can be eliminated.

Having described specific preferred embodiment of the invention with reference to the accompanying drawings, it is to be understood that the invention is not limited to those precise embodiment, and that various changes and modifications may be effected therein by one skilled in the art without departing from the scope or spirit of the invention as defined in the appended claims.

What is claimed is:

1. A room air conditioner, comprising:

a housing including a lower portion in which an air inlet is formed, and an upper portion in which an air outlet is formed, the upper portion being rotatable about an axis;

a blower for circulating air through the housing from the inlet to the outlet;

a heat exchanger disposed in the housing for changing the temperature of air circulated therethrough;

a motor for rotating the upper housing portion about the axis;

sensors for detecting a position of the upper Portion relative to the lower portion during rotation of the upper portion;

an input mechanism by which a user inputs rotation signals; and a controller connected to the input mechanism and the motor for operating the motor in accordance with input signals from the input member, wherein the motor is operable to rotate the upper portion by 180 degrees when a shut-off signal is given.

2. The air conditioner according to claim 1 wherein the upper portion is rotatable about a vertical axis, a conduit extending along the axis between the lower and upper portions for conducting air to the upper portion.

3. The air conditioner according to claim 2 wherein the upper portion is fixed to the conduit, the conduit being rotatable about the axis, the motor connected to the conduit for rotating the conduit.

4. The air conditioner according to claim 3 further comprising a horizontal plate affixed to the conduit, the plate including a hole aligned with the axis, the motor connected to the conduit to rotate the conduit and plate together, the upper portion being fixed upon the plate.

5. The air conditioner according to claim 4 wherein the heat exchanger, blower, and motor are mounted in the lower portion.

6. The air conditioner according to claim 1 wherein the motor is operable to oscillate the upper portion about the axis.

7. The air conditioner according to claim 1 wherein the motor comprises an electric motor and gears driven thereby.

8. The air conditioner according to claim 1, wherein the motor includes a gear arrangement driven by the motor.

9. A method of controlling an air discharge path of a room air conditioner, the air conditioner comprises a housing having a lower portion in which is formed an air inlet for receiving room air, an upper portion in which there is formed an air outlet for discharging the air back into the room, a heat exchanger disposed in a travel path of the air for changing the air temperature, and a blower for circulating the air through the housing, the method comprising the steps of:

A) manually inputting a rotation signal into a controller;

B) operating the blower and heat exchanger to conduct room air through the housing while changing the temperature thereof; and C) oscillating the upper portion of the housing relative to the lower portion of the housing about a vertical axis.

10. The method according to claim 9 wherein step C further comprises detecting rotary positions of the upper portion by means of sensors which define limits for an oscillation path of the upper portion.

11. The method according to claim 9, further including the step of rotating the upper portion by about 180 degrees when the air conditioner is shut off.

* * * * *